US012269637B2

(12) United States Patent
Cerf

(10) Patent No.: US 12,269,637 B2
(45) Date of Patent: Apr. 8, 2025

(54) HANDLE FOR HEAT SHRINK FILM

(71) Applicant: Alain Cerf, Redding Beach, FL (US)

(72) Inventor: Alain Cerf, Redding Beach, FL (US)

(73) Assignee: Polycerf, Inc., Pinellas Park, FL (US)

( * ) Notice: Subject to any disclaimer, the term of this patent is extended or adjusted under 35 U.S.C. 154(b) by 145 days.

(21) Appl. No.: 16/869,261

(22) Filed: May 7, 2020

(65) Prior Publication Data

US 2021/0347513 A1 Nov. 11, 2021

(51) Int. Cl.

| | |
|---|---|
| ***B65B 53/02*** | (2006.01) |
| ***B65B 11/50*** | (2006.01) |
| ***B65B 61/10*** | (2006.01) |
| ***B65B 61/14*** | (2006.01) |

(52) U.S. Cl.

CPC ..... *B65B 61/14* (2013.01); *B65B 11/50* (2013.01); *B65B 53/02* (2013.01); *B65B 61/10* (2013.01)

(58) Field of Classification Search

CPC ..... B65B 61/10; B65B 61/14; B65B 11/50; B65B 11/52; B65B 53/02

See application file for complete search history.

(56) References Cited

U.S. PATENT DOCUMENTS 3,274,302 A * 9/1966 Anderson ..... B65B 51/22 53/442
3,892,057 A * 7/1975 Goode ..... B65B 61/182 53/442
3,892,614 A * 7/1975 Levy ..... B65G 49/069 156/273.1
4,700,528 A * 10/1987 Bernard ..... B65B 61/14 53/413
6,138,437 A * 10/2000 Focke ..... B65B 19/228 53/212
7,395,637 B2 * 7/2008 Angelini ..... B65B 41/02 53/134.1
8,424,272 B2 * 4/2013 Cerf ..... B65B 61/14 53/134.1
9,926,089 B2 * 3/2018 Ageling ..... B65D 71/08
10,752,416 B2 * 8/2020 Goto ..... B65D 75/002
2005/0132665 A1 * 6/2005 Angelini ..... B65B 41/02 53/134.1
2009/0071102 A1 * 3/2009 Cerf ..... B65B 21/245 53/410
2011/0139664 A1 * 6/2011 Ageling ..... B65D 71/08 53/147
2018/0354694 A1 * 12/2018 Goto ..... B65D 75/004

* cited by examiner

*Primary Examiner* — Andrew M Tecco
(74) *Attorney, Agent, or Firm* — Mark C. Johnson; Johnson Dalal

(57) ABSTRACT

The objective of this invention is to provide a handle for carrying an article or a bundle of bottles that is more resistant to tearing and delaminating and can carry heavy loads. This is accomplished by placing a strip on the inside of the wrapping material so that the strip that forms the handle is enclosed within the wrapping material. The strip film maintains direct contact with the wrapping film. Direct contact is achieved by electrostatic bonding of the handle film on the wrapping film. Therefor more than 80% of the handle seals to the wrapping film.

11 Claims, 3 Drawing Sheets

HANDLE FOR HEAT SHRINK FILM

FIELD OF INVENTION

This invention relates to wrapping an article with a heat shrink film having a handle. The handle is made from a strip of material wherein the strip is completely enclosed inside the wrapping film. The strip is adhered to the film by creating an electrostatically charge.

The following patents are incorporated by reference in its entirety, U.S. Pat. No. 7,836,670 filed on Oct. 18, 2006 titled "Perforated Film Wrapping Machine" and U.S. Pat. No. 8,424,272 filed on Apr. 23, 2013, titled, Apparatus and process for wrapping an article with a heat shrink film having a strip that acts as a handle by the same inventor.

BACKGROUND OF THE INVENTION

Usually a handle is applied to the wrapping film on the outside of a bundle or a wrapped article. The handle is usually glued on the outside of the pack. The term bundle will be used to mean a single article as well as a collection of articles such as bottles. The adhesion of the glued handles to the wrapping material can be affected by heat and dryness of heat shrunk film and the quality of the glue. These handles tend to delaminate as the load increases. The closest prior art is described in U.S. Pat. No. 8,424,274. This patent teaches a strip of material made from a composition that allows the strip to adhere or cling to the wrapping film to prevent the strip from wandering while resting on the wrapping film. The problem with this solution was that the strip still tended to wander and was not always in direct contact with the wrapping film. In places where there was no contact the handle film could not seal(weld) with the wrapping film. Also, there was a need for the handle strip and the wrapping film be capable of being recycled together.

SUMMARY OF THE INVENTION

This problem was solved by creating an electrostatic bond between a strip handle and the wrapping film. The strip is electrostatically bonded to the wrapping film. The electrostatic bonding causes the strip film to stay in almost constant contact with the wrapping film. This allows almost all of the entire strip film to seal (weld) with the wrapping film. Also, the electrostatic bond acts to reduces or prevents the wandering of the strip handle film. The static bonding provides better control and tensioning of the layered films.

The handle strip is made of a material which can thermally adhere to the heat shrink film by sealing (welding) during heat shrinking. Preferably the strip will be made of the same material or similar composition as the heat shrink film web so that the maximum adhesion will be achieved and will be heat shrinkable. The carrying load will dictate the thickness and the width of the handle strip. Usually a minimum of 2 mil. thickness of low-density polyethylene is required for the strip handle.

The invention is not limited to any particular heat shrinking film wrapping machine or process where a handle is desired.

DETAILED DESCRIPTION OF THE INVENTION

Figure 1:
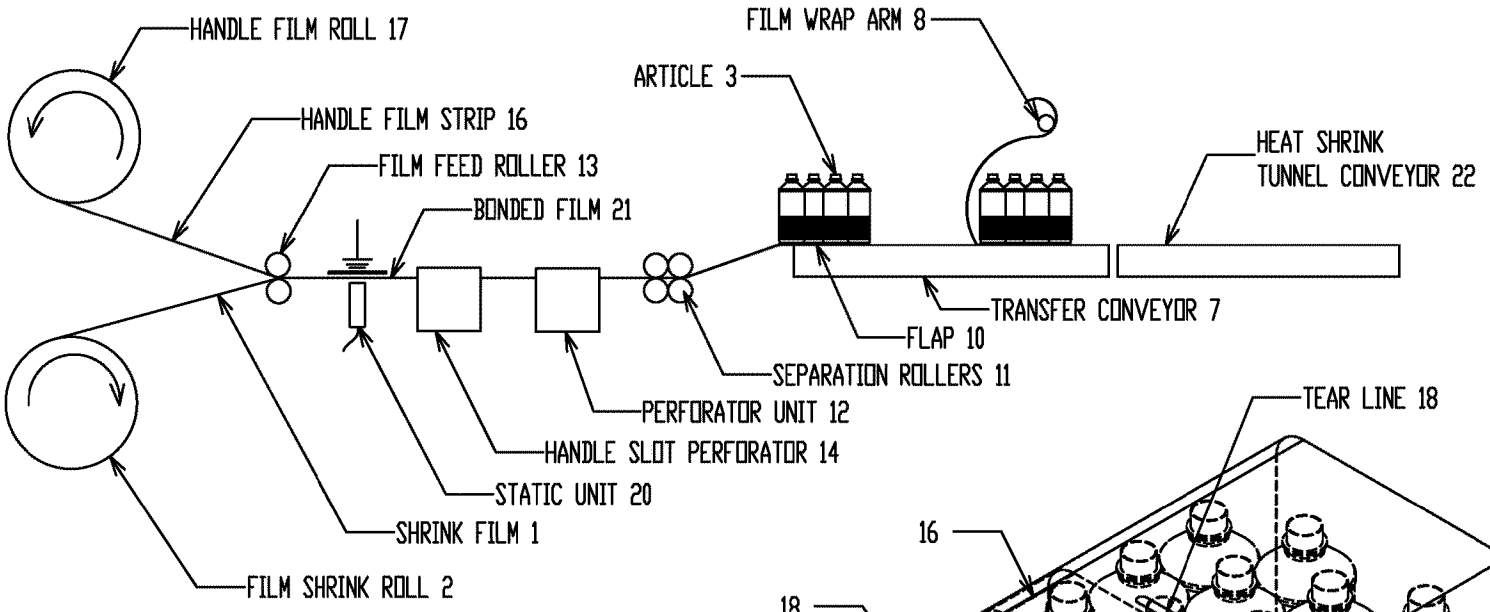
FIG. 1 shows a handle strip being applied to a heat shrink film for wrapping a bundle of bottles by forming an overlap

FIG. 1 is like FIG. 1 in U.S. Pat. No. 8,424,272. The main difference is an electrostatic bond between the strip and the wrapping film.

FIG. 1 shows a single roll (17) having a continuous strip (16) of plastic material to be used as a handle being fed inline simultaneously with a heat shrinkable film wrapping film (1) from film roll (2). The handle strip (16) and shrink film (1) joint together at film feed rollers (13). If desired there can be multiple strip handles simultaneously joined to the wrapping film. Afterwards the films are bonded together with a static unit (20). After film bonding, the bonded film (21) moves through a handle slot perforation module (structure) (14). The perforations are caused by pressing a knife with pointed teeth into the film to perforation the film creating tear line 18 shown in FIG. 2. The same type of structure is used for perforation unit (12). The module is adjustable to accommodate both single and dual handles, or multiple handle widths, located in the machine flow direction or in the transverse direction. The handle perforation module (14) will make two perforated lines thru the shrink film outside of each handle strip (16) to create a tear line 18 for a person's fingers to enter the wrapping film and grip the handle. The handle perforation module (14) can be located before or after the perforation unit (12).

Figure 2:
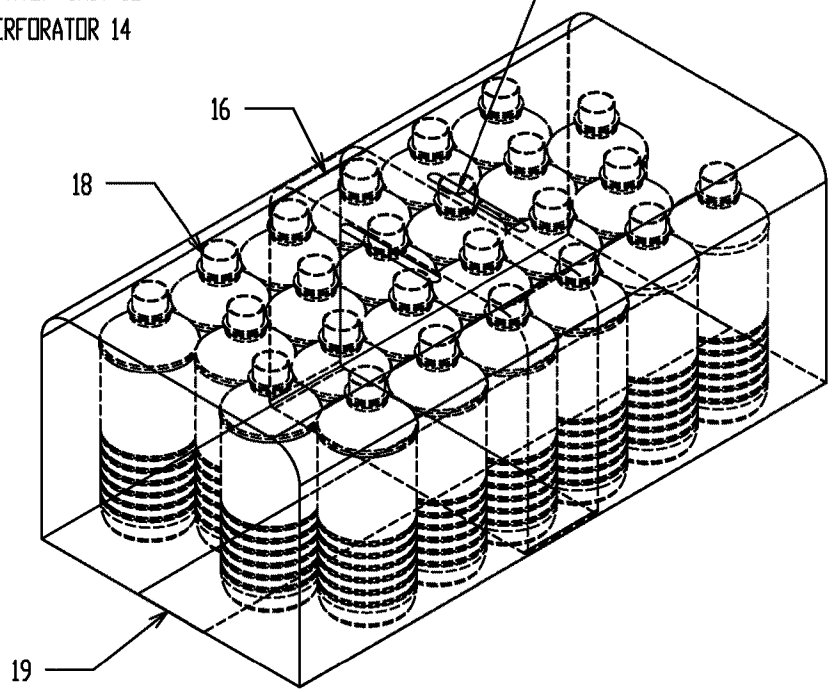
FIG. 2 shows a bundle of bottles wrapped in heat shrink film with a handle encased within the heat shrink film.

The strip bonded film proceeds to the film perforation unit (12) where it is perforated across the width of the bonded films to provide desired length of bonded film to wrap the article (3). Then the bonded films advances to the separation rollers (11) that separates the perforated film at the required length and advances the front edge of the bonded films shown as flap (10) on the top of transfer conveyor (7). A bundle (3) is positioned on top of flap (10). As the bundle advances on the transfer conveyor (7) the wrap arm (8) lifts the tail edge of the bonded film and covers the bundle (3) with the bonded film (21). As the transfer conveyor pushes bundle (3) onto the heat shrink tunnel conveyor (22), the tail edge of the bonded film is pushed underneath the bundle (3) to form an overlap (19) with flap (10). By adjusting the location of the flap and the length of the bonded film, the overlap (19) is usually in the center line of the package as shown in FIG. 2. The overlap (19) creates a sandwich of strip with underlayers of film, strip and film. When the wrapped article is heat shrunk the strip will seal to the film in most all areas to provide a good bond for the handle. Usually at least 85% of the handle film seals to wrapping film. The overlapped portion (19) will also seal and form a welded bond.

Figure 3:
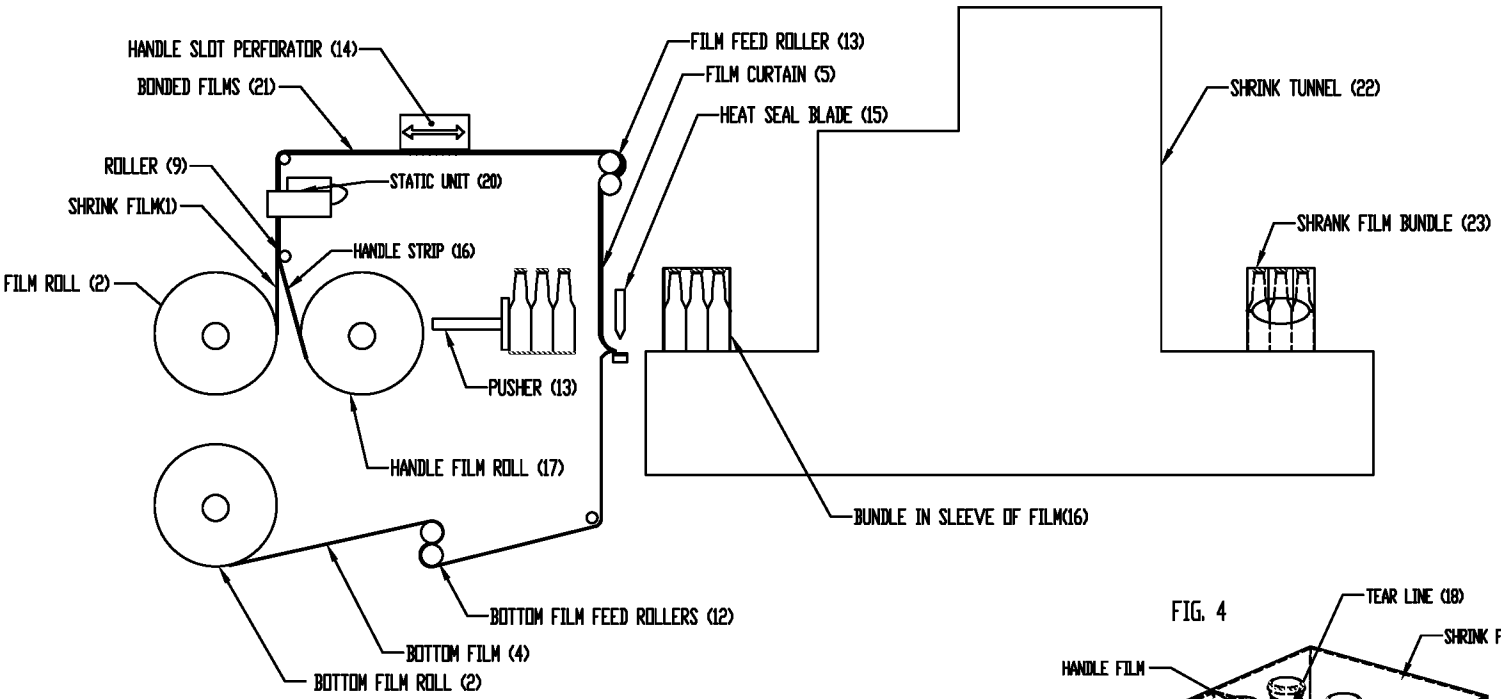
FIG. 3 shows a handle strip being applied to a heat shrink film for wrapping a bundle by pushing the bundle through a vertical film curtain.
Figure 4:
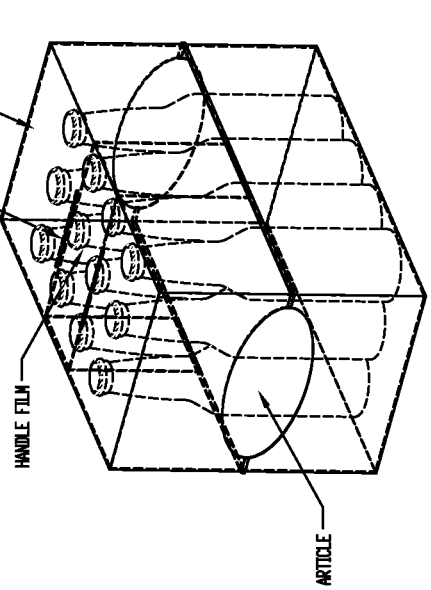
FIG. 4 shows a bundle of bottles wrapped in heat shrink film with a handle strip encased within the heat shrink film where the handle is located on the upper portion of the bundle.

FIG. 3 shows an alternative film wrapping application. A single roll (17) or multiple rolls (17) of handle strip of plastic material (16) is fed inline simultaneously with the top shrink film (1) from roll (2). The handle strip (16) and shrink film (1) joint together at the roller (9). Immediately afterwards the films pass through the static unit 20 Then the bonded films (21) advances into a handle slot perforator (14) that is adjustable to accommodate both single and dual handles and multiple handle widths. The module (14) can be positioned in the machine flow direction and transverse direction. The handle slot perforator (14) will cut two perforated lines thru the top film (1) outside of each handle strip (6) to create a tear line (18) for a person's fingers to enter the film. The bonded films (21) then proceed to the top film feed rollers (13) that feeds the desired length of top film required for each product. The bonded films (21) and the lower film (4) join in front of the heat seal blade (15) to form a curtain of film (5). A bundle or article is are either conveyed or pushed by pusher (13) through the film curtain (5) which sleeve wraps the bundle inside the bonded film (16) and bottom film (4). A hot blade (15) simultaneously cuts the bonded film (16) and the film (4) behind the bundle (16) and joins the films on both sides of the cut. One side creates a welded joint that recreates the vertical film curtain (5). The other side forms a weld joint that completes the film wrapping of the bundle. The bonded strip film (21) is located on the top portion of the bundle. The bundle 3 advances into the shrink tunnel (22) where the handle strip and the shrink film melt together to create a strong integrated handle in the shrunk film package (23). The handle strip is usually orientated on the center line of the package as shown in FIG. 4.

Figure 5:
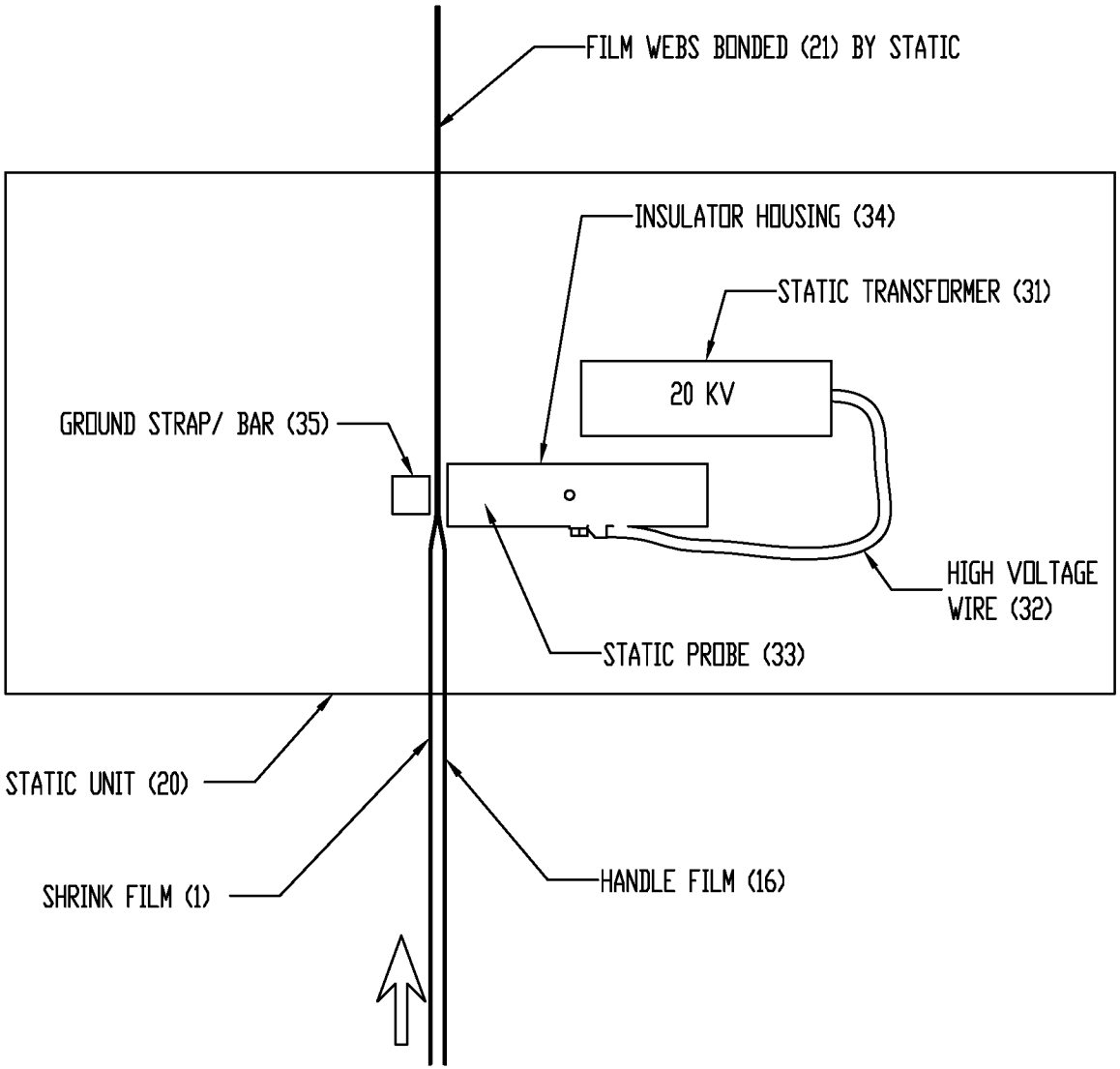
FIG. 5 shows an electrostatic unit for bonding the handle strip to the wrapping film.

FIG. 5 shows a static unit (20). This unit consists of a remote mounted power unit (31) that transfers 20 KV@150 uA DC thru a high-tension lead (31) running out to a static probe (33) housed in an open-ended insulator sleeve (34). The film and handle films pass between the static probe (33) and a grounding strap/bar (35) that is bonded to the machine's frame. The static unit (20) creates a bond between the films allowing the layered films to adhere and to maintain contact to each other.

The invention claimed is:

1. A process for heat shrinking a film wrapped bundle or an article having a handle strip film bonded to the inside of a wrapping film, wherein the handle strip is made from a material that seals to the wrapping film during the heat shrinking and comprising the steps of:

receiving the handle strip film and the wrapping film in a static unit having a ground strap or bar and having a static probe receiving current and housed in an open-ended insulator sleeve, wherein the ground strap or bar and static probe are configured in a directly overlapping configuration;

electrostatically bonding the handle strip to the wrapping film by passing the handle strip film and the wrapping film overlapping and between the ground strap or bar and static probe;

receiving the electrostatically bonded handle strip and wrapping film directly to a perforation module and providing openings in the wrapping film adjacent the handle strip that would allow one to grip over the handle;

film wrapping the bundle having the bonded strip over the bundle so that the strip is enclosed by the wrapping film; and heat shrinking the film wrapped article causing the strip to seal to the film wrapped article.

2. The process according to claim 1 including overlapping a strip bonded wrapping film during film wrapping the article whereby the strip is sandwiched between two layers of wrapping film so that heat shrinking seals the strip to both layers of film.

3. The process according to claim 2 wherein the strip bonded film is perforated to provide a predetermined length of film for wrapping the article.

4. The process according to claim 1 wherein the wrapping film and strip are made of the same material and are heat shrinkable.

5. The process according to claim 1 wherein a flap of the strip bonded wrapping film is pushed on a conveyor.

6. The process according to claim 1 including forming a vertical curtain by joining a strip bonded wrapping film with a wrapping film.

7. The process according to claim 6 including pushing a bundle through the vertical curtain and cutting the film with a hot sealing blade that join s the cut films to form a vertical curtain.

8. The process according to claim 1 where the heat shrinking seals at least 80% of the film handle to the wrapping film.

9. The process according to claim 1 includes providing materials for the strip handle film and wrapping film material that are capable to be recycled together.

10. The process according to claim 1, wherein the static probe receives 20 KV@150 uA direct current from a power unit, further comprising:

electrostatically bonding the handle strip to the wrapping film by applying 20 KV@150 uA current to either the handle strip film or the wrapping film.

11. The process according to claim 1, further comprising:

receiving the handle strip film and the wrapping film in the static unit on a heat shrinking film wrapping machine, wherein the ground strap or bar is bonded to a frame of the heat shrinking film wrapping machine.

* * * * *